US006247615B1

(12) United States Patent
Taylor

(10) Patent No.: US 6,247,615 B1
(45) Date of Patent: Jun. 19, 2001

(54) FLUID FLOW SYSTEM AND METHOD WITH LOW FLOW INHIBITING

(75) Inventor: Ken W. Taylor, Oak Ridge, NC (US)

(73) Assignee: Dresser Equipment Group, Inc., Carrollton, TX (US)

( * ) Notice: Subject to any disclaimer, the term of this patent is extended or adjusted under 35 U.S.C. 154(b) by 0 days.

(21) Appl. No.: 09/434,321

(22) Filed: Nov. 4, 1999

(51) Int. Cl.[7] ..... B67D 5/08
(52) U.S. Cl. ..... 222/59; 222/71
(58) Field of Search ..... 222/71, 59, 638, 222/639, 644

(56) References Cited

U.S. PATENT DOCUMENTS 3,159,310 * 12/1964 Rafferty ..... 222/71
4,580,698 * 4/1986 Ladt et al. ..... 222/71
5,806,716 * 10/1999 Vogt ..... 222/59
5,816,448 * 10/1998 Kobold ..... 222/59
5,971,042 * 10/1999 Hartsell, Jr. ..... 222/71

* cited by examiner

*Primary Examiner*—Philippe Derakshani
*Assistant Examiner*—Thach H Bui
(74) *Attorney, Agent, or Firm*—Haynes and Boone, LLP

(57) ABSTRACT

The present invention provides a fluid flow system and method according to which the fluid is pumped from a source through a conduit while the flow rate of the fluid is sensed and terminated in response to the fluid flow rate falling below a predetermined minimum. After a predetermined time delay the valve is re-opened to allow flow to resume.

11 Claims, 2 Drawing Sheets

10a
10
20
22
18
24
10c
10d
10b
14
14a
16
12

FLUID FLOW SYSTEM AND METHOD WITH LOW FLOW INHIBITING

BACKGROUND

The present invention relates to a gasoline dispensing system and method and, more particularly, to such a system and method in which relatively low flow rates are inhibited.

In fluid flow systems, such as gasoline services station installations, the gasoline is pumped from an underground storage tank, through a conduit, or tube, to a dispenser unit, and through a hose extending from the dispenser unit to a nozzle for dispensing the gasoline into a vehicle tank. A manually operable valve is provided on the nozzle to enable the customer to initiate the dispensing and control the flow of the gasoline during the complete dispensing cycle.

Although a system valve is also provided to control the gasoline flow, the system operates for most of the time at the full flow rate. However, when the system does operate at a low flow rate, such as when the customer partially shuts off the nozzle valve near the end of the dispensing cycle and/or tops off the vehicle tank, a cost-competitive flow meter is often inaccurate. This is significant since it is important that the customer be charged for exactly the amount of gasoline dispensed. Also, certain government regulations require relatively high accuracy of the metered flow during all flow conditions.

Therefore what is needed is a fluid flow system of the above type which inhibits the fluid flow below a predetermined rate and thus insures high accuracy metering of the flow that is metered.

SUMMARY

The present invention provides a fluid flow system and method according to which the fluid is pumped from a source through a conduit while the flow rate of the fluid is sensed and terminated in response to the fluid flow rate falling below a predetermined minimum.

A major advantage is achieved with the system and method of the present invention since a cost-competitive flow meter can be used without any danger of inaccurate fluid flow measurement.

DETAILED DESCRIPTION

Figure 1:
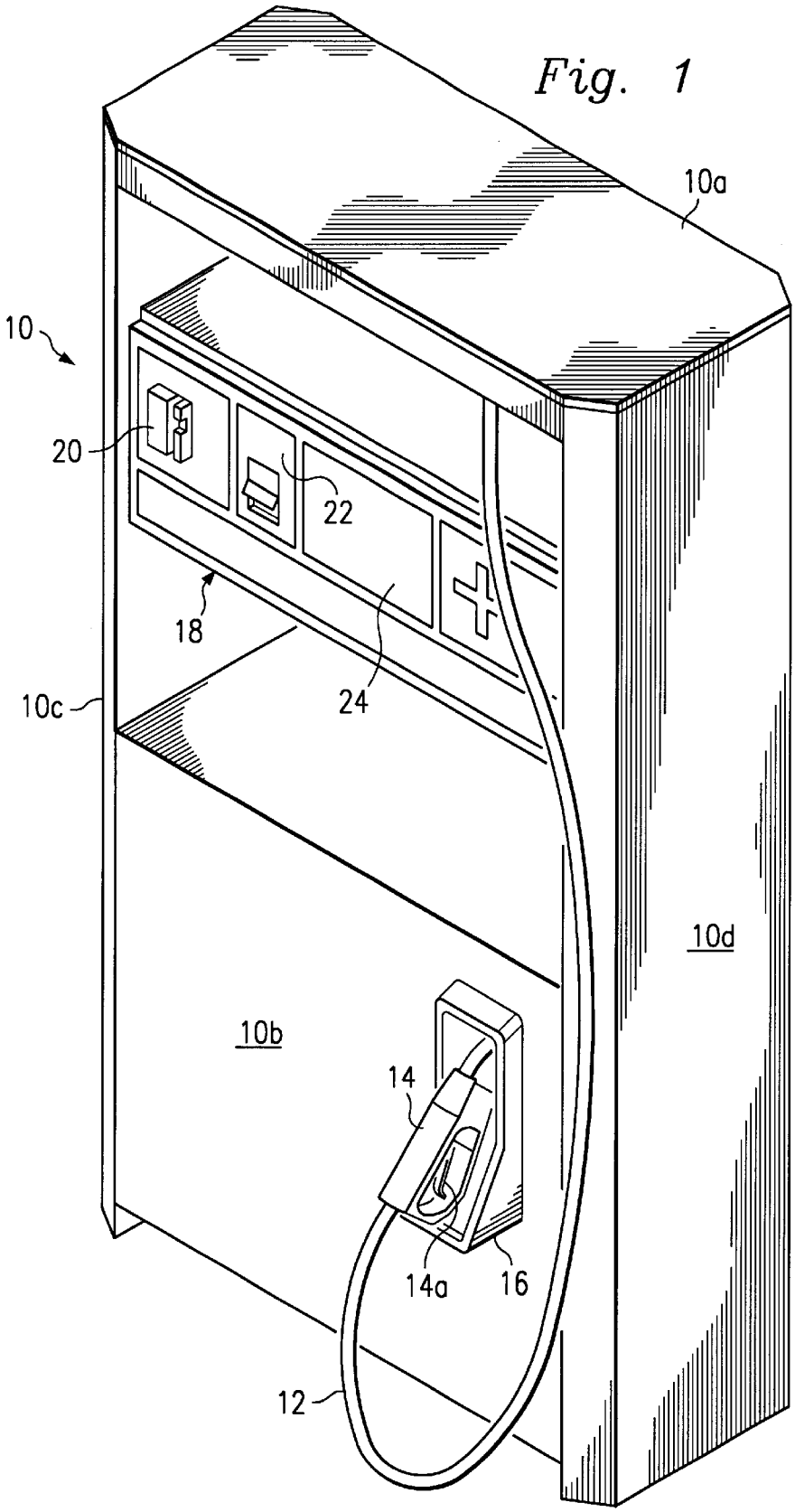
FIG. 1 is an isometric view of gasoline dispensing unit according to an embodiment of the present invention.

With reference to FIG. 1, the fluid flow system of an embodiment of the present invention will be described, by means of example, as a gasoline dispensing system for dispensing gasoline to vehicles at a service station, or the like. To this end, the reference numeral 10 refers, in general, to a dispenser unit having an upper housing 10*a* and a lower housing 10*b* connected by two spaced upright support members 10*c* and 10*d*.

Hydraulics are provided that include one or more conduits or tubes (not shown) connected to one or more underground tanks for storing the gasoline to be dispensed. These conduits extend from the lower housing 10*b* through one of the support members 10*c* and 10*d* to the upper housing 10*a* for passing gasoline to one end of a hose 12 which extends from the upper housing 10*a*. The other end of the hose 12 is connected to a nozzle 14 for dispensing gasoline from the storage tank to a vehicle. The nozzle 14 has a valve (not shown) that is normally closed but can be opened by a trigger, or lever, 14*a* that can be manually actuated in a conventional manner. Although not shown in the drawings, it is understood that the nozzle 14 includes an interlock that prevents the opening of the nozzle valve under relatively low pressure conditions as will be described. A boot 16 is provided on the front panel of the lower housing 10*b* for receiving the nozzle 14 during non-use.

An electronics housing 18 is provided between the upper housing 10*a* and the lower housing 10*b*, and contains various electronic components, including a credit card reader 20, a receipt dispenser 22, and a display 24 which displays the volume of gasoline dispensed and the cost of same. The respective fronts of the reader 20, the receipt dispenser 22, and the display 24 extend through the front panel, or bezel, of the housing 18.

Although not shown in the drawing, it is understood that a boot, identical to the boot 16, is provided on the opposite, or rear, panel of the housing 10*b* which receives a nozzle, identical to the nozzle 14, which extends from a hose identical to the hose 12. Also, the electronics housing 18 has a rear panel that receives a credit card reader, a receipt dispenser, and a display identical to the reader 20, the dispenser 22, and the display 24, respectively. Since all of this is conventional, it will not be described in further detail.

Figure 2:
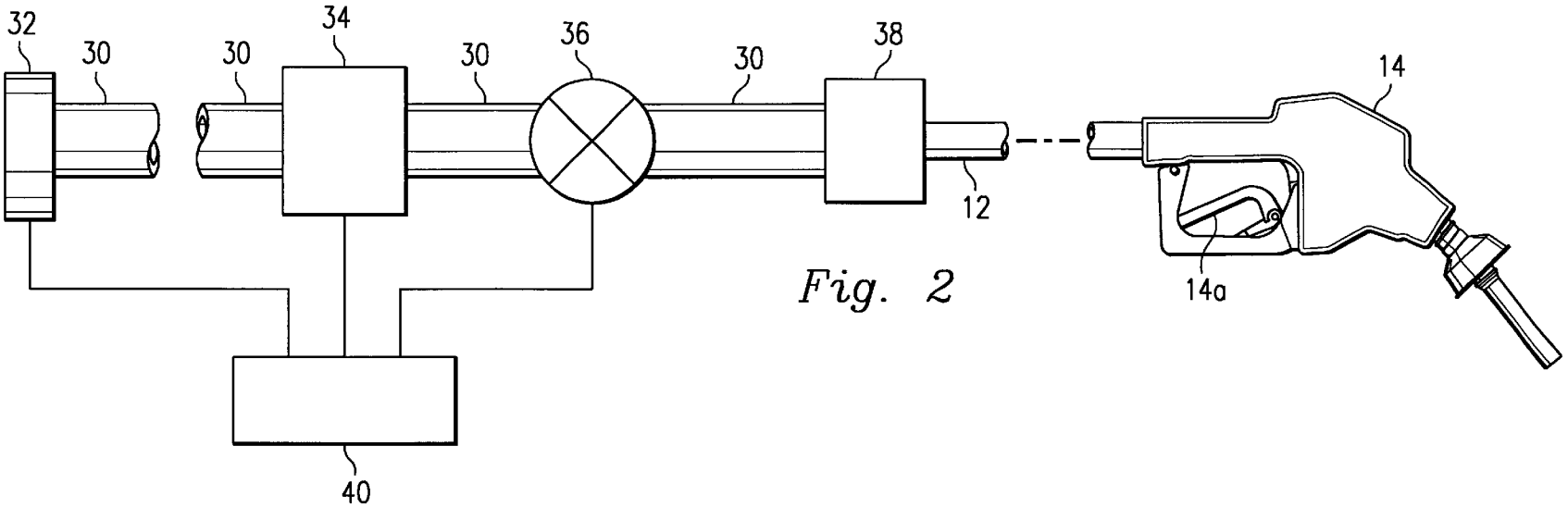
FIG. 2 is schematic view of the fluid flow system according to the embodiment of FIG. 1.

Referring to FIG. 2, one of the above-mentioned conduits extending from a storage tank (not shown) and through the dispenser unit 10 is referred to by the reference numeral 30. A pump 32 is provided at the storage tank or in the lower dispenser housing 10*b* and is connected to the conduit 30 for pumping the fuel from the storage tank, and a flow meter 34 is connected to the conduit 30 for metering the flow of the gasoline through the conduit. It is understood that the meter 34 is electrically connected to the display 24 (FIG. 1) for providing a display of the amount of gasoline dispensed and the cost of same, all in a conventional manner.

A flow control valve 36 is also connected to the conduit 30, preferably downstream of the meter 34, and operates in a conventional manner to control the flow of the gasoline through the conduit, and the amount that is dispensed into the vehicle tank under the additional control of the nozzle 14.

The conduit 30 extends to a fitting, or adapter, 38 which permits the corresponding end of the conduit to be connected to the hose 12, and therefore to the nozzle 14, in fluid flow communication in a conventional manner.

The sections of the conduit 30 shown in FIG. 2, as well as the meter 34 and the valve 36, are all located in the dispenser unit 10. The fitting 38 is preferably located on the lower portion of the upper housing 10*a* of the dispenser unit 10, and the hose 12 extends from the latter fitting and is in fluid flow communication with the conduit 30.

A control unit 40, preferably in the form of a computer, a microprocessor, a CPU, or the like, is provided and is electrically connected to the pump 32, the meter 34, and the valve 36. The control unit 40 receives input signals from the meter 34 corresponding to the fluid flow rate in the conduit 30, and includes a software program that enables it to generate output signals based on this input signal which output signals are used to close the control the valve 36 in a manner to be described.

In order to initiate operation of the dispenser unit 10, the customer activates the main system switch, in the form of a push button, a lever, or the like, on the unit 10. This switch is connected to the control unit 40 which functions to start the pump 32, open the valve 36, to permit dispensing of the gasoline. Gasoline is thus pumped through the conduit 30, the hose 12 and to the nozzle 14 until the pressure rises to a value to permit dispensing of the gasoline. The gasoline can be manually dispensed by the customer by actuating the trigger 14*a* of the nozzle 14 to open the nozzle valve.

After dispensing some gasoline, in the event the customer partially releases the trigger 14*a* to partially close the valve of the nozzle 14 in order to top off the vehicle tank or slow down and/or stop delivery for whatever reason, the meter 34 will sense the fluid flow rate falling below a predetermined minimum value and the control unit 40 will respond accordingly and close the valve 36 to completely shut off the fluid flow. The control unit 40 then opens the valve 36 after a predetermined relatively short delay. This will allow the customer to continue dispensing the gasoline as long as the fluid flow rate extends above the above predetermined minimum rate.

As an example of the time periods that could be involved, the software for the control unit 40 can be programed so that the above-mention predetermined minimum fluid flow rate is between 2–5 liters per minute, and, if the flow rate is below the predetermined minimum, the valve 36 would be shut for periods extending between 0.5 to 1.5 seconds, after which it would be opened. Since the pump 32 is pumping gasoline during all this time, during the short times that the valve 36 is closed the pressure builds up in the conduit 30 causing a relatively high flow rate when the valve is opened. These values, and other comparable values, can be selected to allow the customer to top-off, or slow down and/or stop delivery after a specific amount of gasoline has been dispensed.

The control unit 40 can be programed to operate continuously to monitor the flow rate measured by the meter 34 or, alternatively, it could be programed to periodically monitor the flow rate every 0.5 seconds to 1.5 seconds.

If the flow rate is below the predetermined minimum and the valve 36 is closed and opened as described above, the customer may still try to dispense a large volume of gasoline at a slow flow rate, by continually starting and stopping the pump by activating and deactivating the above-mention main system switch. To prevent this, the control unit 40 can be programed to limit the number of starts, and restarts.

A major advantage is achieved with the system and method of the present invention since low flow rates over an extended period of time, and therefore the chance for inaccurate flow rate measurements are eliminated. Therefore, a cost-competitive flow meter can be used without any danger of inaccurate fluid flow measurement.

Of course, if multiple grades of fuel are provided in separate storage tanks, the number of conduits 30 extending from the tanks to the dispenser unit 10 would increase accordingly, and above system would be used with each conduit.

It is understood that variations may be made to the foregoing without departing from the scope of the invention. For example, the specific values set forth above are for the purpose of example only, it being understood that they can vary within the scope of the invention. Also, although reference is made to "conduits" it is understood that pipes, tubes, hoses, lines and any other type of fluid flow device could be used within the scope of the invention. Further, the specific location of the various components discussed above that are connected to the conduit 30 can be varied within the scope of the invention. For example, the meter 32 can be located downstream of the valve 34 rather than upstream as shown in FIG. 2. Further, the spatial references, such as "upper" and "lower" are for the purpose of illustration only and do not limit the specific orientation or location of the structure described above. Still further, the system and method of the present invention are not limited to a gasoline dispensing system but are equally applicable to any fluid flow system.

It is understood that other variations, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluid dispensing system comprising a source of fluid, a nozzle for manually dispensing the fluid, a conduit connected between the source and the nozzle a pump for pumping the fluid from the source through the conduit, and to the nozzle for dispensing, a meter in the conduit for measuring the flow rate of the fluid flowing through the conduit a valve disposed in the conduit and movable between an open position in which it permits the flow of the fluid through the conduit for dispensing by the nozzle, and a closed position in which it prevents the flow of the fluid through the conduit; and a control unit for receiving input signals from the meter corresponding to the flow rate of the fluid, for closing the value in response to the flow rate falling below a predetermined minimum, and for opening the valve after a predetermined time delay.

2. The system of claim 1 wherein, during the time delay, the pressure in the conduit builds up so that, after the time delay, the flow rate through the conduit is above the predetermined minimum.

3. The system of claim 1 wherein the predetermined time delay is between 0.5 and 1.5 seconds.

4. The system of claim 1 wherein the predetermined minimum fluid flow rate is between 2–5 liters per minute.

5. A fluid flow method comprising the steps of pumping the fluid from a source through a conduit, measuring the flow rate of the fluid in the conduit, terminating the fluid flow in response to the fluid flow rate falling below a predetermined minimum, responding to a predetermined time delay after the step of terminating and commencing the fluid flow.

6. The method of claim 5 wherein, during the time delay, the pressure in the conduit builds up so that, during the step of commencing, the flow rate through the conduit is above the predetermined minimum.

7. The method of claim 5 wherein the predetermined time delay is between 0.5 and 1.5 seconds.

8. The method of claim 5 wherein the predetermined minimum fluid flow rate is between 2–5 liters per minute.

9. The method of claim 5 further comprising the step of dispensing the fluid in response to predetermined fluid flow rate conditions.

10. The system of claim 1, further comprising a switch for starting and stopping operation of the pump, and wherein the control unit responds to the activation of the switch a predetermined number of times for limiting the number of starts and stops of the pump.

11. The method of claim 5 further comprising the step of providing a switch for initiating and terminating the step of pumping, and responding to the steps of initiating and terminating for limiting the number of initiations and terminations.

* * * * *